US006364551B1

(12) United States Patent
Lesniak et al.

(10) Patent No.: US 6,364,551 B1
(45) Date of Patent: Apr. 2, 2002

(54) MEDIA ADVANCE SYSTEM FOR A PRINTER

(75) Inventors: Christopher M. Lesniak; Algird M. Gudaitis, both of Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/502,427

(22) Filed: Feb. 11, 2000

(51) Int. Cl.[7] ..... B41J 11/42; B41J 15/00
(52) U.S. Cl. ..... 400/582; 400/578
(58) Field of Search ..... 400/582, 578; 318/565, 685, 696

(56) References Cited

U.S. PATENT DOCUMENTS

| | | | | |
|---|---|---|---|---|
| 4,270,868 A | * | 6/1981 | Morgan et al. | 400/320 |
| 4,844,317 A | | 7/1989 | Stodder et al. | |
| 4,916,638 A | | 4/1990 | Haselby et al. | |
| 4,976,555 A | | 12/1990 | Ueyama | |
| 5,238,315 A | | 8/1993 | Kitabata | |
| 5,274,242 A | * | 12/1993 | Dragon et al. | 250/548 |
| 5,291,114 A | | 3/1994 | Shirotori et al. | |
| 5,351,068 A | | 9/1994 | Moon et al. | |
| 5,598,201 A | | 1/1997 | Stodder et al. | |
| 5,703,455 A | | 12/1997 | Miyazaki | |
| 5,705,907 A | * | 1/1998 | Miyzmori et al. | 318/599 |
| 5,793,177 A | * | 8/1998 | Chia | 318/685 |
| 5,825,378 A | | 10/1998 | Beauchamp | |
| 5,980,139 A | | 11/1999 | Chapman et al. | |
| 6,016,207 A | | 1/2000 | Wield | |
| 6,017,114 A | | 1/2000 | Elgee et al. | |
| 6,102,591 A | * | 8/2000 | Chapman et al. | 400/76 |

FOREIGN PATENT DOCUMENTS

| | | |
|---|---|---|
| EP | 0010199 A1 * | 9/1979 |
| EP | 0312324 | 4/1989 |
| EP | 0598600 | 5/1994 |

OTHER PUBLICATIONS

IBM Technical Disclosure Bulletin, Printer Carrier Optimum Move Algorithm, vol. 26, Issue 6, pp. 2856–2860, Nov. 1983.*

British Search Report dated Jun. 11, 2001.

* cited by examiner

*Primary Examiner*—Andrew H. Hirshfeld
*Assistant Examiner*—Charles H. Nolan, Jr.

(57) ABSTRACT

A method of controlling a media-advance drive motor of a printer in a manner that preserves accuracy in the incremental advances of print media between printing swaths, while optimizing throughput and accounting for variations in printer system response characteristics. A printer control algorithm commences each media-advance step by accelerating the media-advance drive motor to a maximum velocity. The motor is thereafter decelerated by controlling the drive voltage to the motor as needed to conform to a predetermined decaying velocity versus position function that is representative of a specimen system. The velocity versus position function is correlated to the required media position so that a media-advance motor following that function will arrive at a zero velocity at the precise instant that the media arrives at the position representing the end of its incremental advance.

16 Claims, 3 Drawing Sheets

MEDIA ADVANCE SYSTEM FOR A PRINTER

TECHNICAL FIELD

This invention relates to methods and apparatus for rapid and accurate advancement of print media.

BACKGROUND AND SUMMARY OF THE INVENTION

Ink-jet printers of interest here include at least one print cartridge that contains ink within a reservoir. The reservoir is connected to a printhead that is mounted to the body of the cartridge. The printhead is controlled for ejecting minute drops of ink from the printhead to a sheet of print medium, such as paper, that is advanced through the printer.

The printer includes a carriage for holding the print cartridge. The carriage is scanned across the width of the paper, and the ejection of the drops onto the paper is controlled to form a swath of an image with each scan. The height of the printed swath (as measured in the direction the media is advanced) is fixed for a particular printhead.

Between carriage scans, the media is advanced so that the next swath of the image may be printed. In most cases, the base of the just-printed swath must be precisely aligned with the top of the next-printed swath so that a continuous image may be printed on the paper. Alternatively, the paper may be advanced by less that a full swath height to effect "shingling" type of printing. In any event, inaccurate media advances between scans of the carriage result in print quality artifacts known as banding.

The prevention of banding artifacts thus calls for precise control of the advancing media in discrete steps between printed swaths. The demand for accuracy in advancing media becomes greater as printhead development leads to higher and higher resolutions, thereby reducing the tolerances permitted in advancing the media.

The speed with which the print media is moved through a printer is an important design consideration called "throughput." Throughput is usually measured in the number of sheets of printed media moved through the printer each minute. A high throughput is always desirable.

The time required for media advance between printed swaths is a large component of the overall time required for the printing task. Moreover, printhead development has and likely will provide increasingly large swath heights so that the media must be advanced a relatively larger distance between swaths, preferably without a reduction in throughput. Thus, the designer must balance the requirements for accurate media advance with the design goal of providing the highest throughput possible.

The tolerances permitted in media advance are so small that variations in system performance must be considered even within the same printer families, where otherwise identical drive motors and associated media-advance mechanisms are specified. For example, the friction characteristics of media-advance mechanisms (gears, feed rollers, etc.) in one printer will not precisely match those of another, otherwise identical printer. The same is true for the characteristics of the motor that drives the media-advance mechanisms. For convenience, these system frictions and motor characteristics will be hereafter collectively referred to as system response characteristics, which, as noted, vary at least to some degree from printer to printer.

The speed with which the printer is operated can exacerbate variations in system response characteristics. Thus, aggressively driving the media advance mechanisms to achieve the highest possible throughput would lead to, for example, banding artifacts in printers having relatively poor system response characteristics.

In the past, printer control systems have been designed to account for variations in system response characteristics so that all printers meet the media advance tolerances. One approach to this is to drive the media advance system conservatively so that acceleration and deceleration rates, as well as maximum velocities, can be achieved by worst-case systems (that is, systems with the poorest system response characteristics). It will be appreciated that this lowest-common-denominator approach inhibits the media-advance performance of systems that have average and above-average system response characteristics.

In other approaches, the conservative, worst-case drive approach is reserved for the end of the media advance step. That is, the media is advanced aggressively (rapidly) in a first stage for a majority of the incremental advance distance, but then slowed during a second ("final approach") stage as the media moves into the proper position. Because of the large position errors that can arise during the first stage, the duration of the second stage is relatively long (despite the fact that the distance moved is small) in order to enable correction of the largest position errors. In this approach, therefore, throughput and media position accuracy is enhanced over what went before, although there remains room for improvement in throughput. The present invention provides that improvement.

The present invention is directed to a method of controlling a media-advance drive motor in a manner that preserves accuracy in the incremental advances of print media between printing swaths, while optimizing throughput and accounting for variations in printer system response characteristics.

The invention is primarily embodied in a printer control algorithm that commences each media advance step with a stage that accelerates the media-advance drive motor to its highest velocity. That is, the drive motor acceleration is not restricted to a predetermined acceleration curve, as may be provided with prior approaches to accommodate the worst-case systems as discussed above.

In the present invention, the printer's processor requirements are reduced during this first stage since the applied motor voltage does not have to be computed during acceleration, as would be the case if the motor were driven to match a predetermined acceleration curve.

This initial acceleration stage of the algorithm eliminates performance penalties that would otherwise apply to systems that can accelerate faster than "worst case" systems. Also, the drive motor is operated more efficiently because it is quickly brought up to an efficient operating range, thereby resulting in a cooler operating temperature and longer motor life.

Upon completion of the acceleration stage, the drive voltage is reduced to zero so that the motor decelerates. During this deceleration stage, the motor velocity is monitored and the drive voltage is adjusted from zero as needed to conform to a predetermined decaying velocity versus position function that is representative of a specimen system. The velocity versus position function is correlated to the required media position so that a media-advance motor following that function will arrive at a zero velocity at the precise instant that the media arrives at the position corresponding to the end of its incremental advance.

In one preferred embodiment, reference is made to the predetermined velocity versus position function for the purpose of selecting the instant when the deceleration stage should begin. The velocity versus position function is recorded in the printer firmware as a look-up table or equivalent equation.

Inasmuch as the decelerating motor generally follows a natural deceleration curve, the servo control effort for keeping the motor velocity on that curve is minimal. Thus, the motor can readily transition to a fully stopped mode because there will be little applied voltage at that time, which, as noted, corresponds to the desired or target position of the media.

Other advantages and features of the present invention will become clear upon review of the following portions of this specification and the drawings.

DETAILED DESCRIPTION OF PREFERRED EMBODIMENTS

Figure 1:
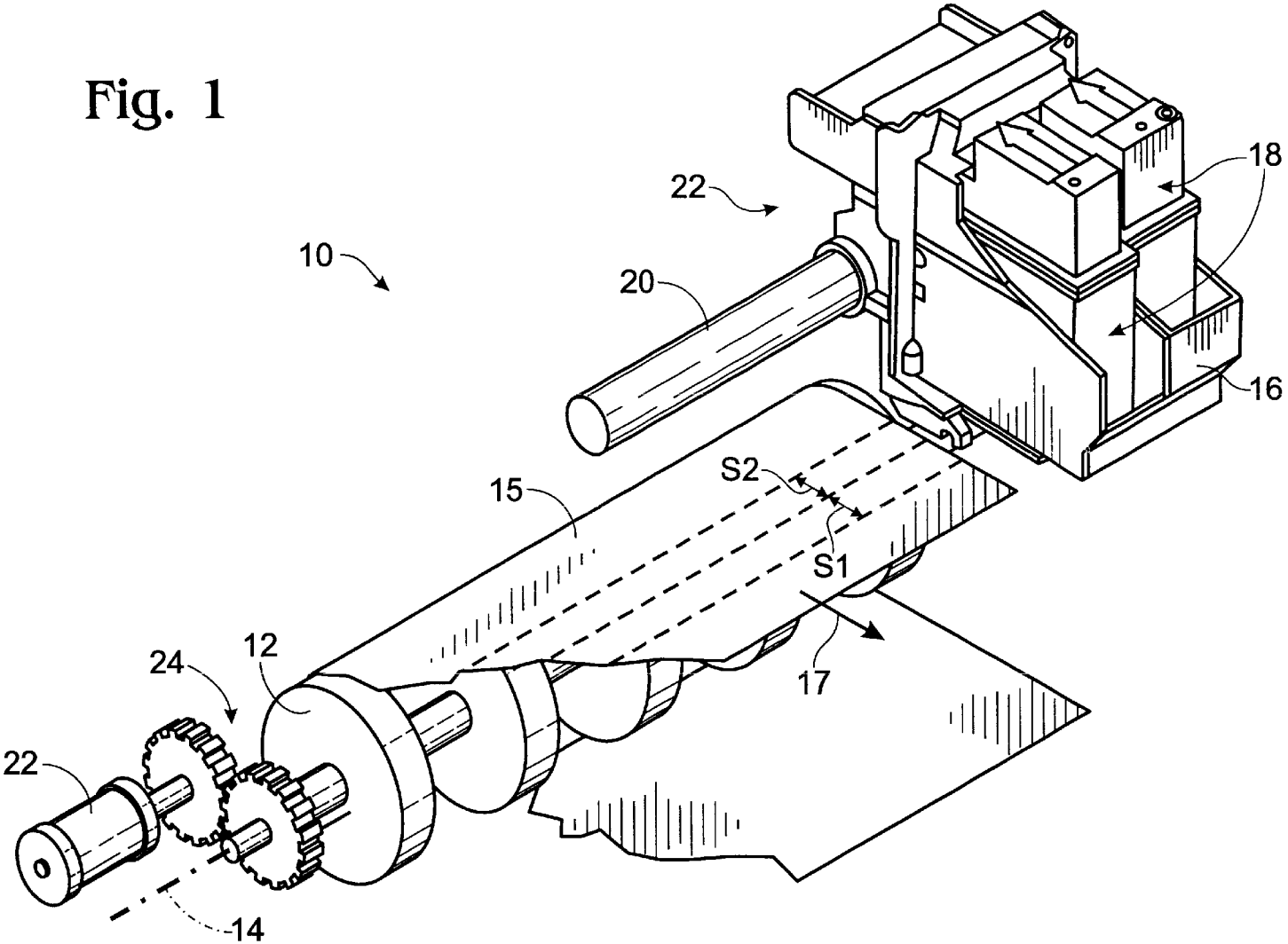
FIG. 1 is a perspective view of carriage, print cartridge, and media-advance components of an inkjet printer of the general type to which the present invention may be adapted.

FIG. 1 depicts media-advance and print cartridge mechanisms used in a typical ink-jet printer 10 and for which the present invention may be adapted. The system includes a feed roller 12 that rotates about an axis 14 to advance, incrementally, paper 15 in a paper-advance direction shown by arrow 17. Other printable media (transparencies, photo media, etc.) may be used as well as paper.

The printer includes a carriage 16 that supports one or more print cartridges 18 (two shown in FIG. 1: a multicolor ink cartridge and a black ink cartridge). The carriage 16 is supported by a carriage support rod 20 and controlled to scan back and forth across the paper 15 along the rod 20 in a direction perpendicular to the paper-advance direction 17.

As the carriage 16 is scanned across the paper 15, a swath of an image or text is printed to the underlying paper. That is, the print cartridges 18 are controlled to print a swath of information. A printed swath is illustrated by the space between the parallel dashed lines labeled "S1" in the figure. In the figure, the carriage 16 is shown at the location it will reach after completing movement across the paper from left to right in printing swath S1.

After the swath S1 is printed, the media-advance mechanisms 24 are operated to advance the paper 15 by one swath height (measured parallel to the paper-advance direction 17) so that the next swath S2 may be printed by the cartridges 18 as the carriage is scanned across the paper 15. Swath S2 is shown in the figure prior to being printed by the pens as the carriage makes a return scan, right to left in FIG. 1).

A DC drive motor 22 that is connected via gears to the feed roller 12 controls the paper advance movement. It is pointed out that any of a variety of mechanisms may be employed for linking the motor 22 and feed roller for controlled advance of the paper. Only two gears are shown here for the sake of simplicity.

Figure 2:
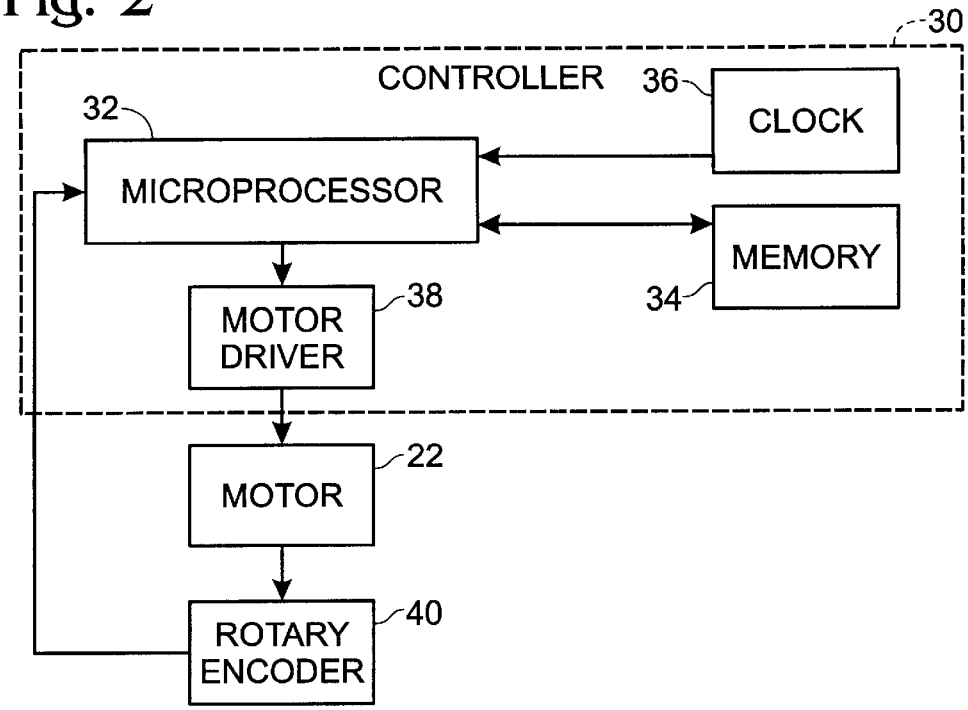
FIG. 2 is a block diagram of a printer controller and associated components for which the present invention may be adapted.

As noted above, the paper advance mechanisms must be controlled in a manner that rapidly advances the paper 15 in a precise increment from a first position (where, for example, swath S1 may be printed) to a second position (where, for example, S2 may be printed). FIG. 2 depicts a block diagram of a printer controller for carrying out the present invention.

In particular, the printer controller 30 includes a multipurpose microprocessor 32, which, for the purposes of simplicity, is described here in connection only with its paper advance tasks. That processor includes associated memory 34 that is pre-programmed to carry out the method of the present invention as explained below. The printer controller 30 is provided with conventional clocking components 36 with which, among other things, certain velocities may be calculated as described more below.

Whenever a printing task is undertaken and, in particular, whenever the print media 15 needs to be advanced by one discrete increment, the microprocessor 32 provides via motor driver 3 8 signals that are suitable for driving the motor 22. In this regard, the signals may be in the form of a drive voltage placed across the input terminals of the motor. The resulting current rotates the motor shaft and connected gears and feed roller 12.

The microprocessor is apprised by the printer firmware (memory 34) of the distance that that paper must be advanced after each swath is printed. The motor motion (which is correlated to the paper advance distance) is monitored by microprocessor 32 via an analog, rotary encoder 40 that is associated with the rotating drive shaft of the motor. Suitably conditioned feedback signals are provided to the microprocessor 32 so that, in conjunction with the system clock information, the microprocessor can instantaneously calculate the motor velocity and paper position.

In accordance with the present invention, the paper-advance motor 22 is controlled as follows to carry out the precise and rapid media advance features summarized above.

As a first stage of this control, the motor 22 is driven via the application of a constant drive voltage. In a preferred embodiment, the constant voltage enables the motor to accelerate as fast as it can. In an alternative embodiment, a constant voltage less than this maximum-acceleration voltage may be selected. In any event, no acceleration curve is imposed, which is to say that no servo control of the motor is undertaken during this full-acceleration stage.

The feedback information from the rotary encoder 40 is monitored so that the microprocessor is continuously apprised (at a very high sampling rate) of the instantaneous velocity of the motor. As noted, however, this monitoring is not employed for controlling or otherwise limiting the motor acceleration during this stage.

The second stage of this control method adjusts the drive voltage applied to the motor 22 so that the motor decelerates to zero velocity. Moreover, this deceleration stage of the motor is controlled so that the motor velocity follows a predetermined, decaying velocity versus position function that is correlated with the paper position such that the paper will move precisely into the second or "target" position (to enable thereafter the printing of swath S2) when the motor reaches the zero-velocity end of the pre-programmed function.

Figure 3:
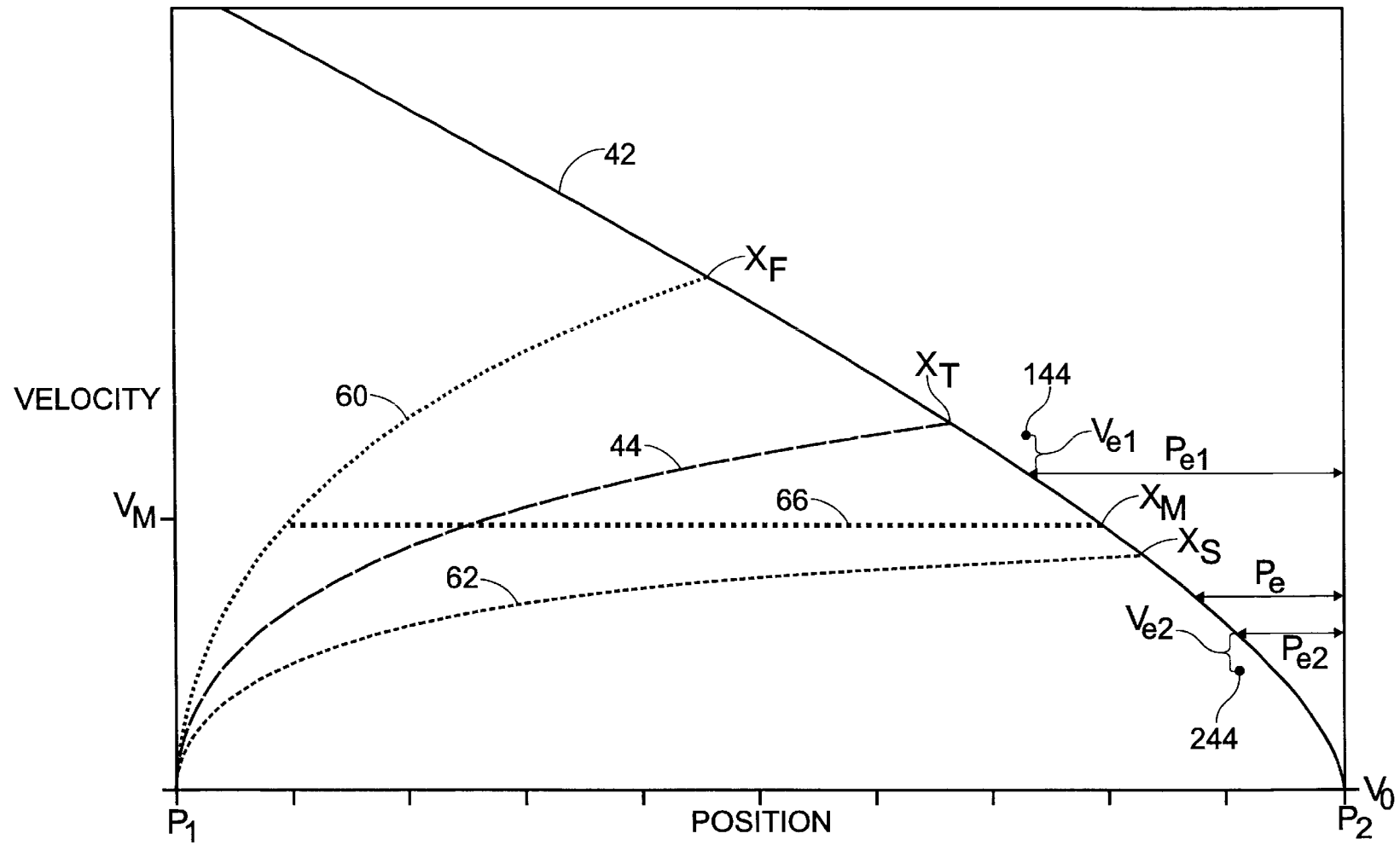
FIG. 3 is a graph illustrating the behavior of different media-advance drive motors operated in accord with the present invention.

The pre-programmed, decaying velocity versus position function can be considered as an exponentially diminishing curve, such as is graphically represented by the solid line 42 in FIG. 3. The graphically depicted deceleration function 42 represents the behavior of a specimen motor (that is, a motor having the same design specifications as the motor 22 used in the printer) as it decelerates following the switch from a full drive voltage to zero voltage. This function information is recorded in advance (as by testing at least one, but preferably several, identical motors) in the printer memory 34. The function may be stored in the form of a look-up table (LUT) or equivalent equation.

The controller 30 associates the deceleration function 42 with the position of the print media. That is, a zero-velocity point $V_0$ in the function 42 is correlated to the target position $P_2$ of the print media. Thus, at any point along this curve 42 there is a pre-established position error $P_e$ that identifies the distance from the target location $P_2$. It will be appreciated, therefore, that a paper-advance motor that is controlled to follow the deceleration curve 42 will move the print media into its proper target position $P_2$ just as the motor reaches the zero-velocity point in the function. The second stage of one preferred control method of the present invention controls the printer motor 22 in just that fashion, as described more fully below.

Figure 4:
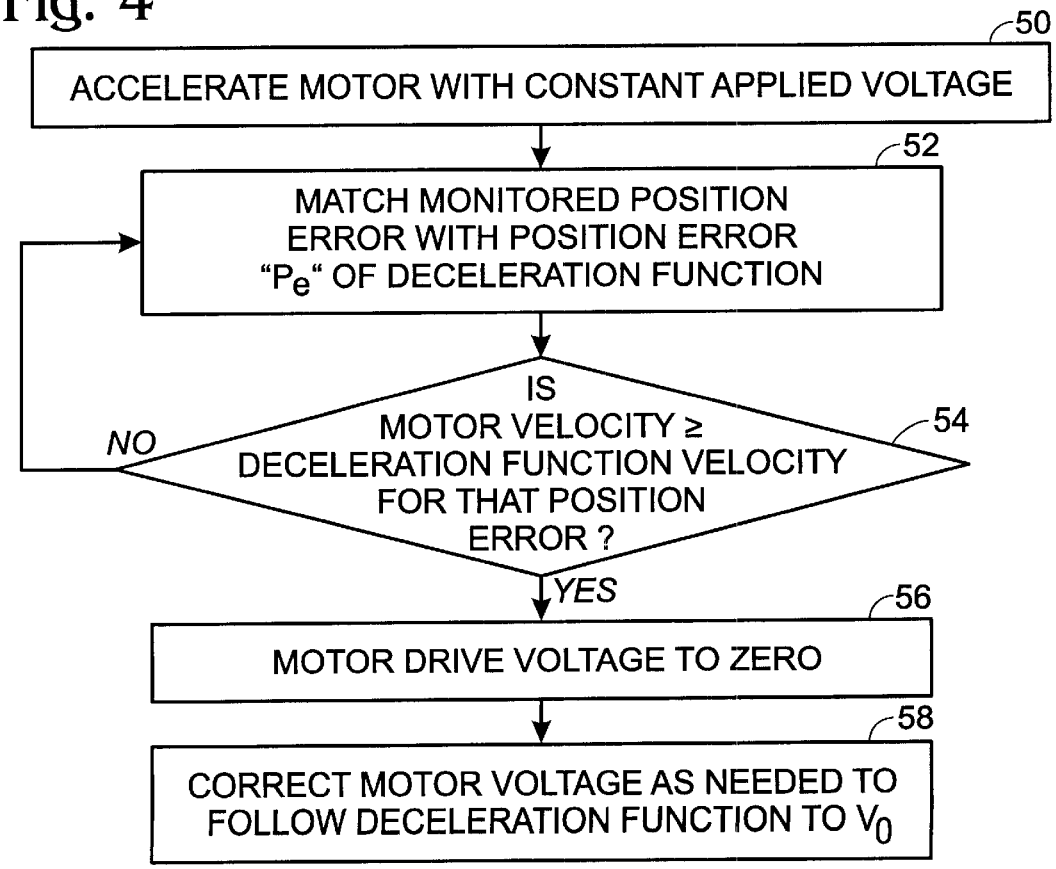
FIG. 4 is a flow diagram for describing process steps undertaken in carrying out method of the present invention.

The combination of the first and second stages of the control method of the present invention can be described with particular reference to FIG. 3 and the flow chart of FIG. 4. The long-dashed-line curve 44 in FIG. 3 represents the response of the drive motor 22 as it is driven via the application of the first-stage constant voltage as described above (step 50, FIG. 4). The motor accelerates from an initial velocity of zero (as the paper is secured in position P1 during the printing of the first swath S1) to its maximum velocity.

In accordance with the present invention, the drive voltage applied to the motor 22 is switched to zero at the instant the motor acceleration curve 44 intersects the predetermined deceleration function 42. In this regard, the microprocessor 32 continuously monitors the motor velocity and calculates the position error, which is the distance of the paper from position $P_2$. The paper position error is matched with a previously stored (as in a look-up table) position error $P_e$ of the deceleration function 42 (steps 52, 54 in FIG. 4).

If the actual motor velocity for the monitored position error of the paper is below the deceleration function velocity associated with that position, the motor will continue to accelerate. Once the motor velocity equals or exceeds that deceleration function velocity, the drive voltage applied to the motor 22 is switched to zero as mentioned above.

Put another way, as soon as the monitored motor acceleration curve 44 intersects the curve 42 of the deceleration function, the acceleration stage or period is concluded, and the control method shifts to the second, deceleration stage of the method. For the acceleration curve 44 of an average or typical motor, this intersection is shown at point $X_T$ in FIG. 3. This stage commences with changing to zero the drive voltage that is applied to the motor (step 56, FIG. 4). Thereafter, the motor velocity is controlled to follow the deceleration function (step 58, FIG. 4).

It is noteworthy here that some motors may accelerate relatively quickly to their maximum velocity. An example of this is shown in the acceleration curve 60 in FIG. 3. The acceleration curve for such a motor will intersect the deceleration curve 42 at a different location ($X_F$ in FIG. 3, a higher velocity) than that $X_T$ of a typical motor. Similarly, the acceleration curve 62 for a slower than typical accelerating motor will intersect the deceleration curve 42 at yet a different location ($X_S$ in FIG. 3, lower velocity) that $X_T$ of a typical motor. Irrespective of where the particular motor acceleration curve intersects the deceleration function curve 42, the motor velocity is thereafter controlled to follow that function.

It is contemplated that some system constraints (such as noise levels) may require that the motor velocity never exceed a maximum $V_M$ level, even though the motor may be capable of accelerating to a higher level before intersecting the deceleration function as discussed above. In such an instance, that maximum velocity of the motor may be maintained at a constant level for an intermediate stage until the position error and velocity corresponding to that constant-velocity motor intersect to commence the deceleration stage as noted above.

This intermediate stage can be considered with reference to the dotted line 66 in FIG. 3. When this optional stage is implemented, the motor velocity will be controlled to stop accelerating when the motor's velocity reaches $V_M$. (Note that some slow-acceleration motors, such as that represented by curve 62, may intersect the deceleration function curve before reaching the established maximum velocity $V_M$.) Once the maximum velocity is reached, the motor velocity is thereafter maintained as near as possible to the maximum, following that curve 66 until intersecting, at $X_M$, the deceleration function 42.

Once the motor velocity (following constant velocity curve 66) intersects the deceleration function curve, the control method then switches to the deceleration stage mentioned above and summarized next in connection with a motor that presents a typical acceleration curve 44. As noted above, minimal control effort is required to ensure that the actual motor velocity tracks the deceleration function 42. For instance, if at a sampled error position $P_{e1}$ the actual motor velocity (shown by point 144 in FIG. 3) is greater than that of the deceleration function 42 by an amount $V_{e1}$, the controller's microprocessor 32 drives the motor with a (small) voltage suitable for reducing the motor velocity by an amount sufficient to match that of the deceleration curve at that error position.

Similarly, if at a sampled error position $P_{e2}$ the actual motor velocity (shown as point 244) is less than that of the deceleration function by an amount $V_{e2}$, the controller's microprocessor 32 drives the motor with voltage suitable for increasing the motor velocity by an amount sufficient to match that of the deceleration curve at that error position.

The adjustments ensure that the system is gradually decelerated and the motor is transitioned to a zero velocity as the paper moves into the target position.

It is noted that the specimen motor may be selected to be one that is known to decelerate less rapidly than the printer motors to be controlled. As a result, any required voltage adjustments as discussed above will be made via a positive applied voltage.

Although preferred and alternative embodiments of the present invention have been described, it will be appreciated by one of ordinary skill that the spirit and scope of the invention is not limited to those embodiments, but extends to the various modifications and equivalents as defined in the appended claims.

What is claimed is:

1. A method of controlling a motor that advances print media from a first position to a second position at which second position the print media advance is stopped, the method comprising the steps of;

providing a decaying velocity versus position function by defining the function to represent a specimen motor velocity decay from a maximum velocity to zero velocity over a period during which zero voltage is applied to the specimen motor;

accelerating the motor during a first stage so that the print media moves out of the first position;

stopping the motor acceleration;

monitoring the motor position and velocity; and controlling the motor as needed for the motor velocity to follow the decaying velocity versus position function as the print media moves into the second position.

2. The method of claim 1 wherein the accelerating step includes applying a voltage to the motor and wherein the stopping step includes applying a zero voltage to the motor.

3. The method of claim 1 wherein the providing step includes defining the function to represent decay from a first velocity to zero velocity over a second stage so that the function reaches a zero velocity value where the media moves into the second position.

4. The method of claim 3 wherein the stopping step includes stopping the motor acceleration when the motor velocity corresponding to a given position of the paper between the first and second positions becomes substantially equal to or greater than a velocity of the velocity versus position function that corresponds to that given position.

5. The method of claim 3 wherein the controlling step is undertaken throughout the second stage.

6. The method of claim 3 wherein the defining step includes recording a look-up table holding values of the function.

7. The method of claim 3 wherein the defining step includes recording an equation corresponding to the function.

8. The method of claim 1 including the step of controlling the motor to maintain a substantially constant velocity following the first stage and before controlling the motor velocity to follow the decaying velocity versus position function.

9. The method of claim 1 wherein the controlling step includes the step of periodically adjusting the motor voltage by all amount sufficient to remove the difference between the monitored motor velocity and the provided function velocity so that the voltage applied is zero in instances where the difference between the monitored motor velocity and the provided function velocity is zero.

10. The method of claim 1 wherein the accelerating step is undertaken by applying voltage to the motor at the beginning of the first stage and without monitoring the applied voltage during the remainder of the accelerating step.

11. The method of claim 1 wherein the accelerating step includes applying a constant voltage to the motor.

12. The method of claim 11 wherein the accelerating step is undertaken in the absence of servo control of the motor.

13. The method of claim 11 wherein the constant voltage is the maximum drive voltage for the motor.

14. The method of claim 1 where the providing step includes testing several other motors of a type like the motor to establish the decaying velocity versus position function.

15. The method of claim 1 wherein the controlling step controls the motor as needed for the motor velocity to follow the decaying velocity versus position function until the print media has reached the second position.

16. A method of controlling a motor that advances print media from a first position to a second position where the print media advance is stopped, the method comprising the steps of.

providing a decaying velocity versus position function by defining the function to represent a specimen motor velocity decay to a zero velocity that corresponds to he second position, the function being represented as a continuous curve;

accelerating the motor during a first stage so that the print media moves out of the first position;

stopping the motor acceleration;

monitoring the motor position and velocity; and controlling the motor as needed for he motor velocity to follow the decaying velocity versus position function as the print media moves into the second position.

* * * * *

UNITED STATES PATENT AND TRADEMARK OFFICE

CERTIFICATE OF CORRECTION

PATENT NO. : 6,364,551 B1
DATED : April 2, 2002
INVENTOR(S) : Christopher M. Lesniak et al.

It is certified that error appears in the above-identified patent and that said Letters Patent is hereby corrected as shown below:

Column 8,
Line 24, "." should read -- : --;
Line 27, "he" should read -- the --.

Signed and Sealed this

Twelfth Day of August, 2003

JAMES E. ROGAN
*Director of the United States Patent and Trademark Office*